US011840870B1

(12) United States Patent
Fang

(10) Patent No.: US 11,840,870 B1
(45) Date of Patent: Dec. 12, 2023

(54) LOCK STRUCTURE

(71) Applicant: PUJIANG COUNTY SHANGXIN INDUSTRY AND TRADE CO., LTD., Jinhua (CN)

(72) Inventor: Juanying Fang, Hangzhou (CN)

(73) Assignee: PUJIANG COUNTY SHANGXIN INDUSTRY AND TRADE CO., LTD., Jinhua (CN)

( * ) Notice: Subject to any disclaimer, the term of this patent is extended or adjusted under 35 U.S.C. 154(b) by 0 days.

(21) Appl. No.: 18/079,567

(22) Filed: Dec. 12, 2022

(51) Int. Cl.

| | |
|---|---|
| ***E05B 9/02*** | (2006.01) |
| ***E05B 15/10*** | (2006.01) |
| ***E05B 9/08*** | (2006.01) |
| *E05B 63/08* | (2006.01) |
| *E05B 9/00* | (2006.01) |

(52) U.S. Cl.
CPC ..... *E05B 9/02* (2013.01); *E05B 9/08* (2013.01); *E05B 15/10* (2013.01); *E05B 9/002* (2013.01); *E05B 63/08* (2013.01); *E05B 2009/004* (2013.01)

(58) Field of Classification Search
CPC ..... E05C 19/00; Y10T 292/0989; Y10T 292/1097; Y10T 292/0994; Y10T 70/8459; Y10T 70/8551; Y10T 70/8865; Y10T 70/8838; E05B 9/00; E05B 9/02; E05B 9/08; E05B 9/002; E05B 15/10; E05B 63/08; E05B 2009/004; E05B 55/00; E05B 55/005; E05B 57/00
USPC ..... 70/448, 461, 462; 292/244, 169.21
See application file for complete search history.

(56) References Cited

U.S. PATENT DOCUMENTS

| | | | | |
|---|---|---|---|---|
| 2,823,538 A * | 2/1958 | Fresard | E05B 55/00 | 70/462 |
| 3,361,464 A * | 1/1968 | Foster | E05B 63/044 | 292/165 |
| 5,666,830 A * | 9/1997 | Litvin | E05B 9/00 | 292/335 |
| 5,813,255 A * | 9/1998 | Tell, III | E05B 63/04 | 70/462 |
| 6,045,169 A * | 4/2000 | Frolov | E05B 63/202 | 292/335 |
| 6,536,248 B1 * | 3/2003 | Fan | E05C 1/163 | 292/169.18 |
| 8,424,935 B2 * | 4/2013 | Moon | E05B 63/0056 | 292/336.5 |
| 2008/0042452 A1 * | 2/2008 | Moon | E05B 15/102 | 292/337 |

* cited by examiner

*Primary Examiner* — Suzanne L Barrett
(74) *Attorney, Agent, or Firm* — Daniel M. Cohn; Howard M. Cohn

(57) ABSTRACT

A lock structure includes a lock housing defining an accommodating cavity and a lock head. An outer end surface of the lock housing defines a through hole communicated with the accommodating cavity. The lock head is movably arranged in the accommodating cavity. An outer end of the lock head is movably arranged in the through hole to stretch out of or retract into the through hole. Operating ports are defined on sides of the lock housing. The operating ports are communicated with the accommodating cavity. The lock head includes a movable piece and a lock tongue piece, the movable piece is arranged in the accommodating cavity. The lock tongue piece passes through the through hole and extends into the accommodating cavity. The lock tongue piece is detachably connected with the movable piece.

7 Claims, 4 Drawing Sheets

LOCK STRUCTURE

TECHNICAL FIELD

The present disclosure relates to a field of lock technology, and in particular to a lock structure.

BACKGROUND

A lock body is one of components of a lock. There are many lock bodies in the prior art, such as one-way lock bodies, three-way lock bodies, four-way lock bodies, etc., which are generally applied on security doors to ensure basic security of the security doors. Lock cylinders are for controlling operations of the lock bodies. The lock bodies are configured to open doors and windows, and play an important role in security.

In the prior art, opening directions of the lock bodies are fixed, and there are lock bodies opened from a left inner side of a door, lock bodies opened from a left outer side of the door, lock bodies opened from a right inner side of the door, and lock bodies opened from a right outer side of the door, so that when installing a lock body on a door with a specific opening direction, it is necessary to choose a matching lock body. However, it is easy to install the lock body opened from a wrong direction with respect to the door with the specific opening direction. Moreover, a lock head on the lock body is generally integrated with the lock body, so if the lock body is incorrectly installed, the lock body needs to be disassembled as a whole, which is troublesome to operate. Therefore, it is necessary to develop the lock body in the prior art.

SUMMARY

In view of defects in the prior art, a purpose of the present disclosure is to provide a lock structure that is capable of easily changing an opening direction thereof, which effectively solves a problem that when a conventional lock body is incorrectly installed, the lock body needs to be disassembled as a whole, leading to a troublesome operation.

To achieve the above purpose, the present disclosure provides the lock structure that is capable of easily changing the opening direction thereof. The lock structure comprises a lock housing defining an accommodating cavity and a lock head. An outer end surface of the lock housing defines a through hole communicated with the accommodating cavity. The lock head is movably arranged in the accommodating cavity. An outer end of the lock head is movably arranged in the through hole to stretch out of or retract into the through hole. Operating ports are defined on sides of the lock housing. The operating ports are communicated with the accommodating cavity. The lock head comprises a movable piece and a lock tongue piece, the movable piece is arranged in the accommodating cavity. The lock tongue piece passes through the through hole and extends into the accommodating cavity. The lock tongue piece is detachably connected with the movable piece.

Optionally, the lock tongue piece is detachably connected with the movable piece through at least one screw. The at least one screw directly faces the operating ports.

Optionally, the movable piece defines a first connecting portion. The first connecting portion defines at least one screw hole. An inner end of the lock tongue piece extends outwards to from a second connecting portion. The second connecting portion defines at least one fixing hole. The second connecting portion overlaps the first connecting portion. The at least one fixing hole directly faces the at least one screw hole. The at least one screw passes through the at least one fixing hole and is screwed with the at least one screw hole.

Optionally, an inner end surface of the lock tongue piece defines a positioning groove. One end of the first connecting portion is inserted into the positioning groove for positioning.

Optionally, two screw holes are provided side by side. Two screws and two fixing holes are provided corresponding to the two screw holes. Each of the screws passes through a corresponding fixing hole to screw with a corresponding screw hole.

Optionally, a front side and a rear side of the lock housing define a respective operating port.

Optionally, the lock housing comprises a main housing and a cover plate. The cover plate is fixed to the main housing. The cover plate and the main housing are enclosed to from the accommodating cavity.

Optionally, the cover plate is detachably connected with the main housing through at least one bolt.

Compared with the prior art, the lock head comprises the movable piece and the lock tongue piece. The lock tongue piece passes through the through hole to extend into the accommodating cavity and the lock tongue piece is detachably connected to the movable piece. Further, the operating ports are defined on the lock housing. When the lock structure is installed in a wrong direction, the lock tongue piece is separately detached and is re-installed after changing the opening direction, so there is no need to disassemble the whole lock structure, which is very easy to operate.

10—lock housing; 11—main housing; 12—cover plate; 13—bolt; 101—accommodating cavity; 102—through hole; 103—operating port; 20—lock head; 21—movable piece; 211—first connecting portion; 212—screw hole 22—lock tongue piece; 221—second connecting portion; 222—fixing hole; 223—positioning groove; 23—screw.

DETAILED DESCRIPTION

Figure 1:
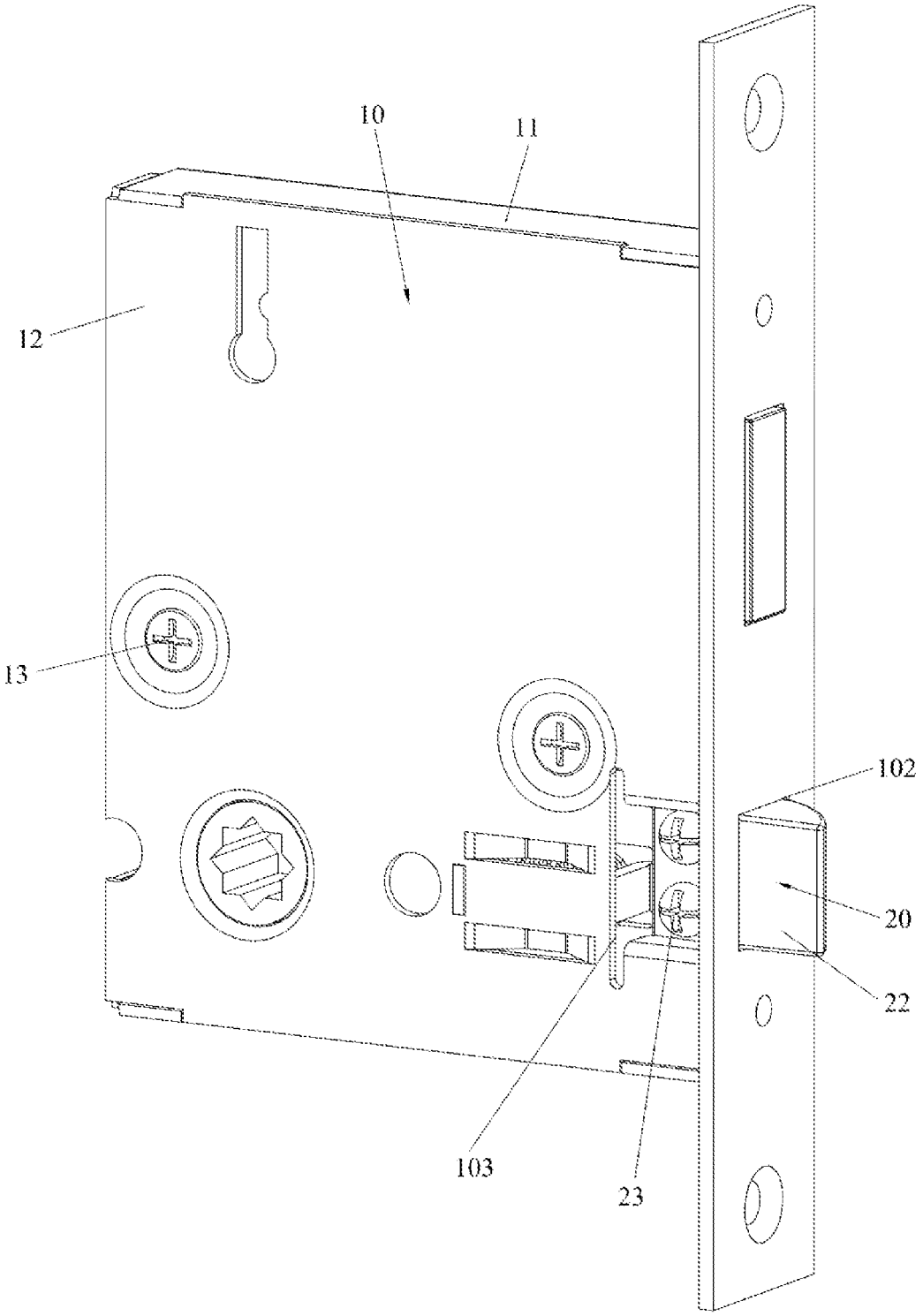
FIG. 1 is a schematic diagram of a lock structure according to one optional embodiment of the present disclosure.
Figure 2:
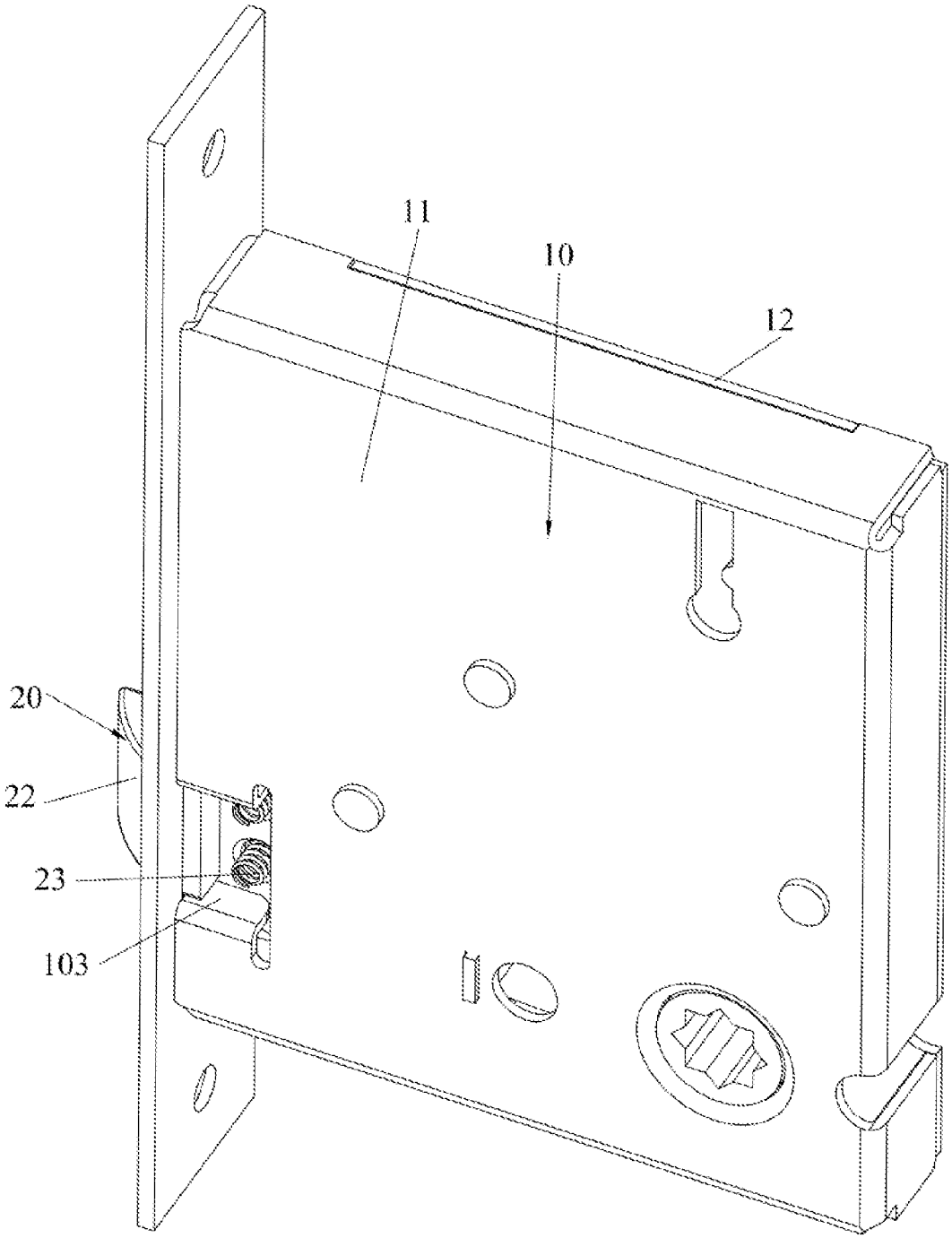
FIG. 2 is another schematic diagram of the lock structure according to one optional embodiment of the present disclosure.
Figure 3:
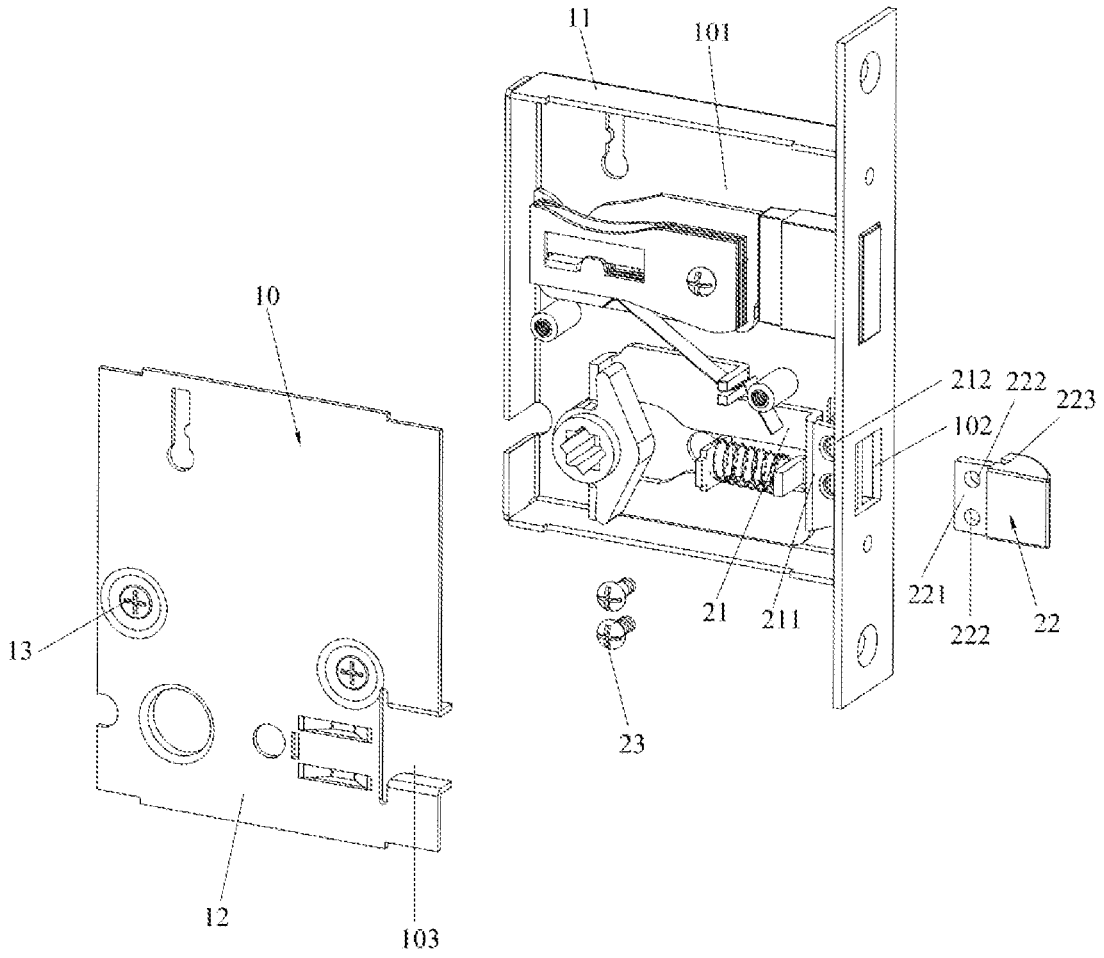
FIG. 3 is an exploded schematic diagram of the lock structure according to one optional embodiment of the present disclosure.
Figure 4:
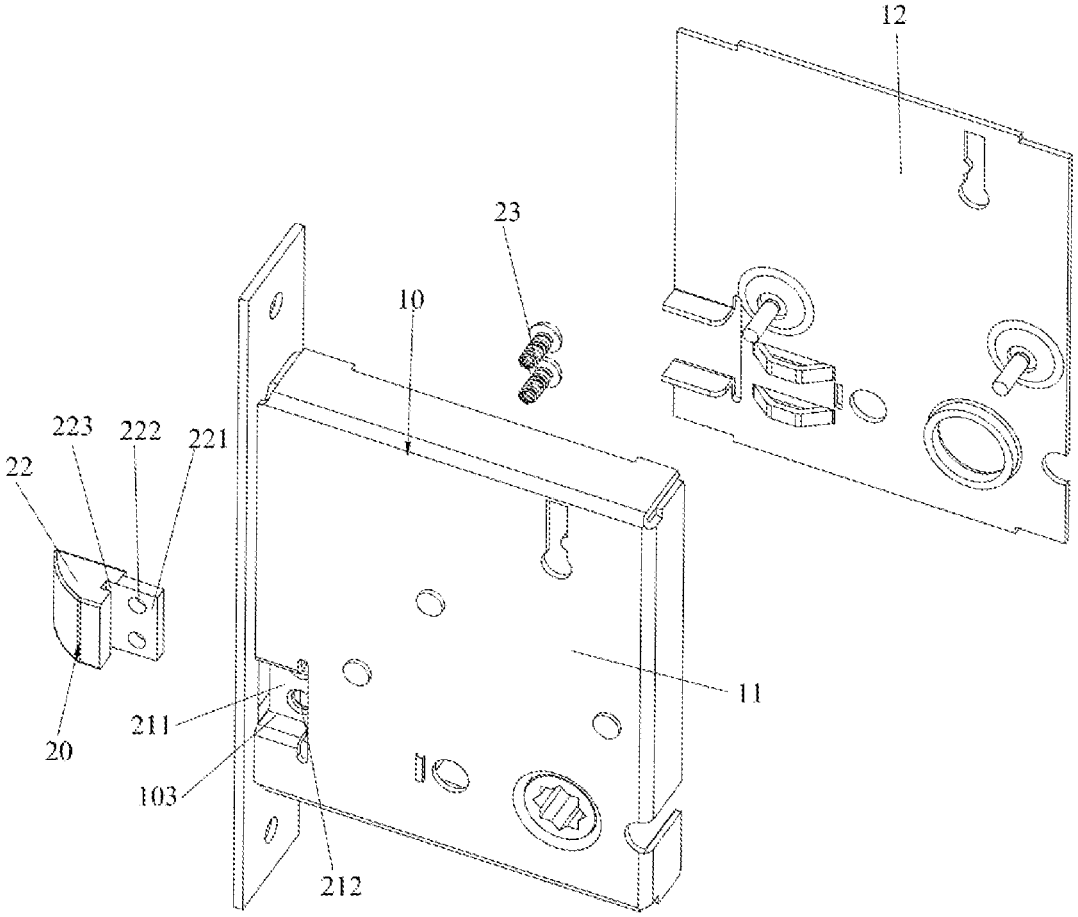
FIG. 4 is another exploded schematic diagram of the lock structure according to one optional embodiment of the present disclosure.

As shown in FIGS. 1-4, in one optional embodiment, the present disclosure provides a lock structure that is capable of easily changing an opening direction thereof. The lock structure comprises a lock housing 10 and the lock head 20. The lock housing 10 defines an accommodating cavity 101. An outer end surface of the lock housing 10 defines a through hole 102 communicated with the accommodating cavity 101. Operating ports 103 are defined on sides of the lock housing 10. The operating ports 103 are communicated with the accommodating cavity 101. in the embodiment, the lock housing 10 comprises a main housing 11 and a cover plate 12. The cover plate 12 is fixed to the main housing 11.

The cover plate 12 and the main housing 11 are enclosed to from the accommodating cavity 101. Moreover, the cover plate 12 is detachably connected with the main housing 11 through bolts 13. The lock structure has a simple structure and is convenient to assemble and disassemble. Further, a front side and a rear side of the lock housing 10 define a respective operating port 103, making is more convenient to assemble and disassemble.

The lock head 20 is movably arranged in the accommodating cavity 101. An outer end of the lock head 20 is movably arranged in the through hole 102 to stretch out of or retract into the through hole 102. The lock head 20 comprises a movable piece 21 and a lock tongue piece 22. The movable piece 21 is arranged in the accommodating cavity 101. The lock tongue piece 22 passes through the through hole 102 and extends into the accommodating cavity 101. The lock tongue piece 22 is detachably connected with the movable piece 21 through at least one screw 23. The at least one screw 23 directly faces the operating ports 103, which facilitates assembly and disassembly of the at least one screw 23.

In the embodiment, the movable piece 21 defines a first connecting portion 211. The first connecting portion 211 is a sheet. The first connecting portion 211 defines at least one screw hole 212. An inner end of the lock tongue piece 22 extends outwards to form a second connecting portion 221. The second connecting portion 221 is a sheet. The second connecting portion 221 defines at least one fixing hole 222. The second connecting portion 221 overlaps the first connecting portion 211. The at least one fixing hole 222 directly faces the at least one screw hole 212. The at least one screw 23 passes through the at least one fixing hole 222 and is screwed with the at least one screw hole 212. Furthermore, an inner end surface of the lock tongue piece 22 defines a positioning groove 223. One end of the first connecting portion 211 is inserted into the positioning groove 223 for positioning, making connection between the first connecting portion 211 and the second connecting portion 221 stable.

Further, two screw holes 212 are provided side by side. Two screws 23 and two fixing holes 222 are provided corresponding to the two screw holes 212. Each of the screws 23 passes through a corresponding fixing hole 222 to screw with a corresponding screw hole 212, making connection between the lock tongue piece and the movable piece stable and reliable. The lock structure has the simple structure and is easy to assemble and disassemble.

A method of using the lock structure is illustrated as follows:

When the opening direction of the lock structure needs to be changed, a user is able to hold a screwdriver and inserts the screwdriver into one of the operating ports 103 arranged on one side of the lock housing 10. Then the screws 23 are loosened and removed by the screwdriver, and the lock tongue piece 22 is pulled out from the through hole 102. Then, the lock tongue piece 22 is rotated 180° around a central axis thereof and is inserted into the through hole 102. The second connecting portion 221 and the first connecting portion 211 are controlled to overlap each other. Then, the screwdriver is inserted into the other one of the operating ports 103 on another side of the lock housing 10 to screw the screws 23. Each of the screws 23 passes through the corresponding fixing hole 222 and is screwed with the corresponding screw hole 212. By above operations, an opening direction of the lock tongue piece 22 is changed and thus changing the opening direction of the lock structure.

In the present disclosure, the lock head comprises the movable piece and the lock tongue piece. The lock tongue piece passes through the through hole to extend into the accommodating cavity and the lock tongue piece is detachably connected to the movable piece. Further, the operating ports are defined on the lock housing. When the lock structure is installed in a wrong direction, the lock tongue piece is separately detached and is re-installed after changing an installation direction, so there is no need to disassemble the whole lock structure, which is very easy to operate.

The above are only optional embodiments of the present disclosure and specifically depict technical principles of the present disclosure. These descriptions are only for explaining the principles of the present disclosure, and cannot be interpreted as limiting of the protection scope of the present disclosure in any way.

Based on the explanations, any modification, equivalent replacement, and improvement made within the spirit and principle of the disclosure, and other specific implementations of the present disclosure obtained by those skilled in the art without creative work, should fall within the protection scope of the present disclosure.

What is claimed is:

1. A lock structure, comprising:

a lock housing defining an accommodating cavity; and a lock head;

wherein an outer end surface of the lock housing defines a through hole communicated with the accommodating cavity; the lock head is movably arranged in the accommodating cavity; an outer end of the lock head is movably arranged in the through hole to stretch out of or retract into the through hole; operating ports are defined on sides of the lock housing; the operating ports are communicated with the accommodating cavity; the lock head comprises a movable piece and a lock tongue piece; the movable piece is arranged in the accommodating cavity; the lock tongue piece passes through the through hole and extends into the accommodating cavity; the lock tongue piece is detachably connected with the movable piece;

wherein the lock tongue piece is detachably connected with the movable piece through at least one screw; the at least one screw directly faces the operating ports;

wherein the movable piece defines a first connecting sheet, the first connecting sheet defines at least one screw hole; an inner end of the lock tongue piece extends outwards to form a second connecting sheet; the second connecting sheet defines at least one fixing hole; the second connecting sheet overlaps the first connecting sheet side by side; the at least one fixing hole directly faces the at least one screw hole; the at least one screw passes through the at least one fixing hole to screw with the at least one screw hole;

wherein an inner end surface of the lock tongue piece defines a positioning groove adjoining to the second connecting sheet; one end of the first connecting sheet is inserted into the positioning groove for embedding the first connecting sheet.

2. The lock structure according to claim 1, wherein two screw holes are provided side by side; and two screws and two fixing holes are provided corresponding to the two screw holes; each of the screws passes through a corresponding fixing hole to screw with a corresponding screw hole.

3. The lock structure according to claim 1, wherein a front side and a rear side of the lock housing define a respective operating port.

4. The lock structure according to claim 1, wherein the lock housing comprises a main housing and a cover plate; the cover plate is fixed to the main housing; the cover plate and the main housing are enclosed to from the accommodating cavity.

5. The lock structure according to claim 4, wherein the cover plate is detachably connected with the main housing through at least one bolt.

6. The lock structure according to claim 1, wherein the first connecting sheet and the second connecting sheet are flat sheet having a same shape, the first connecting sheet and the second connecting sheet are stacked together side by side.

7. The lock structure according to claim 1, wherein the positioning groove is a slot below a bottom of the second connecting sheet.

* * * * *